United States Patent [19]

Casey

[11] 4,105,274

[45] Aug. 8, 1978

[54] CHILD SAFETY DEVICE FOR RETAINING ELECTRICAL PLUGS

[76] Inventor: Richard W. Casey, 20 E. Cedar St., Apt. 15-C, Chicago, Ill. 60611

[21] Appl. No.: 783,827

[22] Filed: Apr. 1, 1977

[51] Int. Cl.[2] ..... H01R 13/54

[52] U.S. Cl. ..... 339/75 P; 339/103 R

[58] Field of Search ..... 339/75 P, 37, 103 R

[56] References Cited

U.S. PATENT DOCUMENTS

| | | | |
|---|---|---|---|
| 2,659,059 | 11/1953 | Johnson | 339/75 P |
| 3,811,104 | 5/1974 | Caldwell | 339/75 P |
| 4,045,108 | 8/1977 | Olsen | 339/75 P |

*Primary Examiner*—Roy Lake
*Assistant Examiner*—E. F. Desmond
*Attorney, Agent, or Firm*—Fitch, Even, Tabin & Luedeka

[57] ABSTRACT

A safety device is disclosed for use in retaining an electrical plug or the like within an electrical wall outlet socket so as to prevent withdrawal of the plug by a child. The device includes a base portion for securing the device to the electrical outlet and has oppositely directed bifurcated arm portions adapted to engage and retain electrical plugs within the associated electrical outlet sockets to prevent removal of the plugs by a child.

11 Claims, 10 Drawing Figures

CHILD SAFETY DEVICE FOR RETAINING ELECTRICAL PLUGS

The present invention relates generally to safety devices for retaining electrical plugs within electrical wall outlet sockets, and more particularly to a novel safety device for such purpose which includes a base portion for attaching the device to an electrical wall outlet and has oppositely directed bifurcated arm portions adapted to engage and retain electrical plugs within the electrical wall sockets to prevent withdrawal of the plugs by children, but which, in one embodiment facilitates removal of the plugs by adults without detachment of the device from the electrical wall outlet.

The dangers to children as a result of improper withdrawal or manipulation of prong-carrying electrical plugs as employed on light cords and electrical appliances and the like to connect the appliances to electrical wall outlet sockets are well known. Contact with the conductive prongs of such a plug when the plug is partially removed from an electrical wall socket before the prongs are completely out of contact with the electrical terminals of the receptacle socket can cause severe burns if not fatal accidents to children.

Numerous devices have been developed in an attempt to prevent access to and manipulation of electrical plugs while connected to electrical wall sockets so as to prevent children from either partially or completely withdrawing the plugs from the electrical wall sockets. The known devices, however, have significant disadvantages in that they frequently require rather complex assembly and also secure the electrical plugs to the associated electrical wall outlets in such a manner as to prevent any withdrawal of the plugs, such as by adults, unless the device and often the electrical sockets are totally removed from the electrical wall outlet.

In accordance with the present invention, a relatively simple and inexpensive safety device for retaining electrical plugs within electrical wall outlet sockets is provided which prevents either partial or complete withdrawal of the plugs from the electrical wall sockets by young children but which, in one embodiment, facilitates withdrawal of the plug by an adult without completely detaching the device from the electrical wall outlet.

Accordingly, one of the primary objects of the present invention is to provide a safety device for use in retaining an electrical plug within an electrical wall outlet socket, which device is of simple construction and relatively inexpensive thereby promoting wide acceptance and use of the device for its intended safety protection.

Another object of the present invention is to provide a safety device for use in retaining electrical plugs within electrical wall outlet sockets, which device includes a base portion for securing the device to a conventional electrical wall outlet socket and which has oppositely directed bifurcated arm portions each of which is adapted to engage the outwardly extending portion of an electrical plug so as to retain the plug within an associated electrical socket to prevent withdrawal by a child.

A feature of one embodiment of the present invention lies in the provision of a safety device for use in retaining electrical plugs within electrical wall sockets so as to prevent withdrawal by children, which device is manipulatable by an adult to remove the plugs without having to detach the device from the associated wall outlet.

Further objects, features and advantages of the present invention, together with the organization and manner of operation thereof, will become apparent from the following detailed description of various embodiments of the invention when taken in conjunction with the accompanying drawings wherein like reference numerals designate like elements throughout the several views, and wherein.

Figure 1:
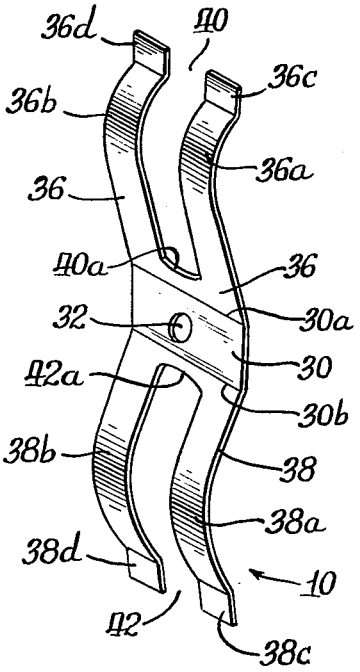
FIG. 1 is a perspective view of a safety device for retaining electrical plugs in accordance with the present invention.

Referring now to the drawings, and in particular to FIGS. 1-4, one embodiment of a safety device constructed in accordance with the present invention is indicated generally at 10. The safety device 10 is preferably of unitary construction and is adapted to be secured to an electrical wall outlet, such as designated generally at 12 in FIGS. 3 and 4, so as to overlie an electrical receptacle 14. The electrical receptacle 14 is of conventional design and has a pair of electrical outlet sockets **14*a* and 14*b* each of which has a pair of socket slots 16 adapted to receive the electrical terminals or prongs 18 (FIG. 4) of an electrical plug 20 forming the terminal end of an electrical cord 22 in a known manner. In the illustrated embodiment, each outlet socket 14*a* and 14*b* has a ground receptacle slot 16*a*** for use with ground-wire systems.

Conventionally, the electrical receptacle 14 has a threaded opening intermediate the socket portions **14*a* and 14*b* which facilitates attachment of a cover plate 24 to the electrical receptacle 14 by means of a screw 26** after the receptacle is electrically connected to electrical conductors within a receptacle box disposed within the wall.

In accordance with the present invention, the safety device 10 is adapted to be secured to the receptacle 14 outwardly of the cover plate 24 to retain the associated electrical plugs 20 within the electrical receptacle portions 14*a* and 14*b* so as to prevent partial or complete withdrawal of the plugs by a young child. To this end, the safety device 10 includes a planar base portion 30 which has a central opening 32 therethrough to facilitate attachment of the base portion to the electrical receptacle by the screw 26. The safety device 10 has a pair of bifurcated arm portions 36 and 38 which are of identical configuration and extend away from the planar base portion 30 in opposite directions therefrom. The bifurcated arm portions 36 and 38 each define a pair of parallel spaced arms 36*a*, 36*b* and 38*a*, 38*b*, respectively. The pairs of spaced arms 36*a*, 36*b* and 38*a*, 38*b*, respectively, define longitudinally extending slots 40 and 42 therebetween the inner ends of which terminate at end surfaces 40*a* and 42*a*, respectively, as shown.

Figure 2:
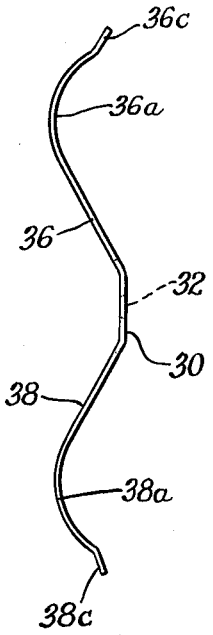
FIG. 2 is a side profile view of the safety device of FIG. 1.

The safety device 10 preferably comprises a unitary member which is preferably made from a suitable metallic material coated with an electrically nonconductive coating material, such as rubber or plastic or the like, to render the device electrically nonconductive. With particular reference to FIG. 2, the bifurcated arm portions 36 and 38 are formed so as to extend angularly away from the plane of the base portion 30, with the intermediate portions of the bifurcated arms 36*a*, 36*b* and 38*a*, 38*b* being generally arcuate in side profile configuration. In the illustrated embodiment, the bifurcated arm portions 36 and 38 are formed outwardly from the plane of the base 30 about parallel bend lines such as indicated at 30*a* and 30*b* in FIG. 1.

Figure 3:
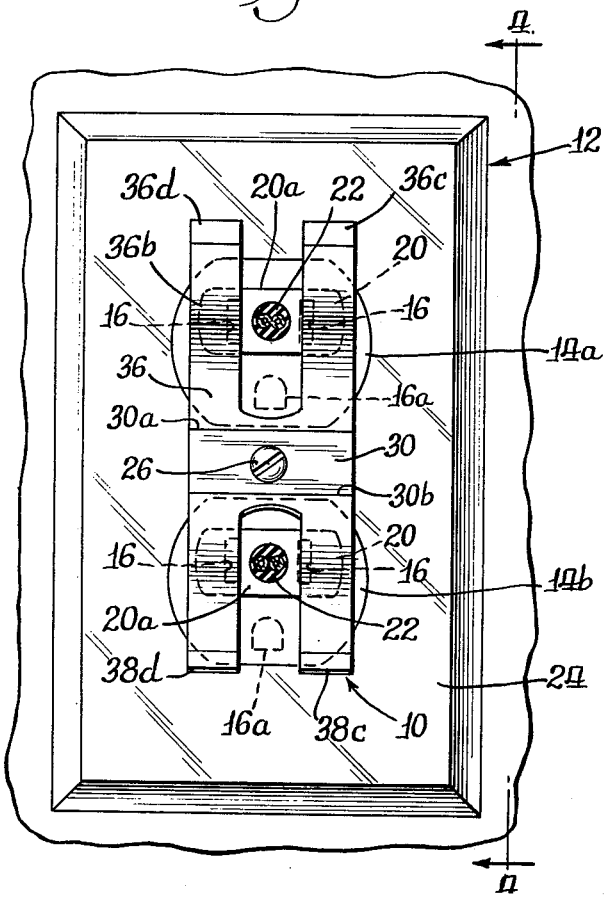
FIG. 3 is a front elevational view illustrating the safety device of FIG. 1 secured to an electrical wall outlet so as to retain electrical plugs within the outlet sockets.

The safety device 10 has a lateral width, considered transverse to its longitudinal axis, sufficient to extend over substantially the full lateral width of the receptacle 12 as shown in FIG. 3. In this manner, the bifurcated arm portions 36 and 38 will overlie the full widths of the plugs 20.

After inserting one or both of the plugs 20 into the electrical sockets 14*a* and 14*b*, the base portion 30 of the safety device 10 is secured against the cover plate 24 of the electrical wall outlet 12 by the screw 26. The bifurcated arm portions 36 and 38 are formed outwardly from the plane of the base portion 30 such that as the base portion is secured against the cover plate 24 the bifurcated arms 36*a*, *b* and 38*a*, *b* engage outwardly extending shoulder surfaces 20*a* on the electrical plugs 20 and securely retain the plugs within the sockets 14*a* and 14*b*. The slots 40 and 42 are of sufficient lateral width to receive the electrical conductors 22 therethrough while the associated arm portions 36*a*, *b* and 38*a*, *b* engage the shoulder surfaces 20*a* on the plugs 20.

Figure 4:
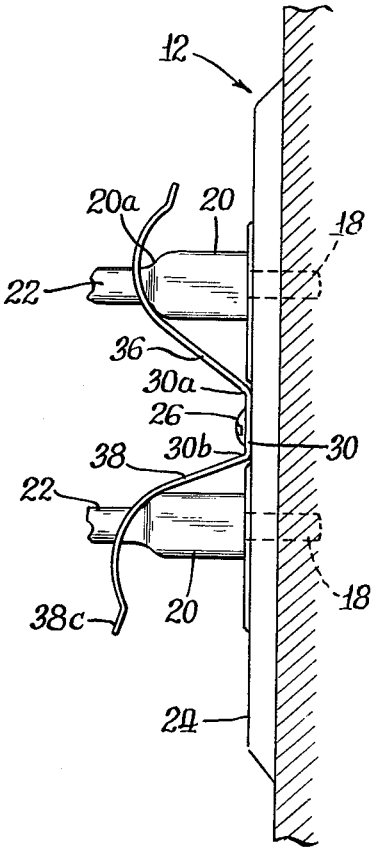
FIG. 4 is a side view taken substantially along the line 4—4 of FIG. 3.

By comparing the configurations of the safety device 10 as shown in FIGS. 2 and 4, it can be seen that the bifurcated arms 36*a*, *b* and 38*a*, *b* are biased outwardly by the plugs 20 from their normal inclined angles relative to the plane of the base portion 30 as the base portion is secured to the outlet 12. The bifurcated arm portions 36 and 38 are made sufficiently flexible about the bend lines 30*a* and 30*b* so that they can accommodate substantially the full range of plug sizes as conventionally available for home usage. On the other hand, the arms 36 and 38 and associated base 30 are made stiff enough to prevent partial or complete removal of either of the plugs 20 from its associated electrical socket by a young child pulling or tugging on the associated electrical cord 22. In this manner, the child may not expose a portion of the prongs 18 of a plug 20 with accompanying danger of electrical shock or the like. By forming the bifurcated arm portions 36*a*, *b* and 38*a*, *b* into arcuate configurations such that the concave surfaces engage the associated plugs 20, it is made more difficult for a child to wiggle the plugs in a manner to remove them from their respective electrical sockets.

Preferably, end tabs 36*c*, *d* and 38*c*, *d* are formed on the outermost ends of the bifurcated arms 36*a*, *b* and 38*a*, *b*, respectively. The end tabs 36*c*, *d* and 38*c*, *d* are formed by bending the ends of the arms slightly outwardly from the general arcuate curvature of the respective arms 36*a*, *b* and 38*a*, *b*, as seen in FIG. 2. As noted, however, the bifurcated arms 36 and 38 are sufficiently rigid to prevent removal of the plugs 20 by a young child.

Figure 5:
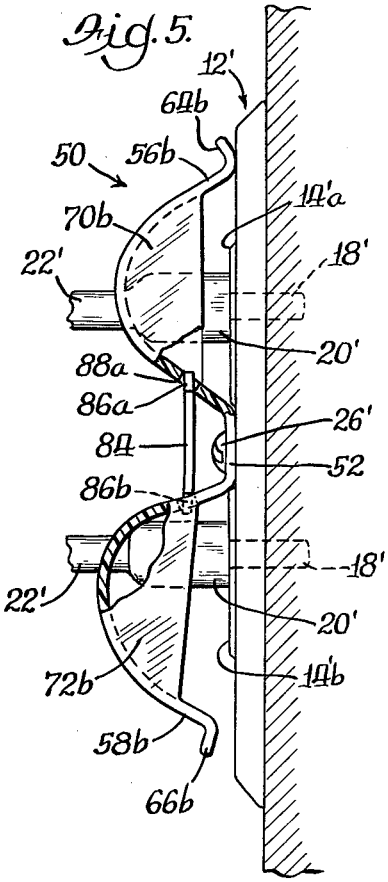
FIG. 5 is a side view similar to FIG. 4 but illustrating another embodiment of a safety device in accordance with the present invention secured to an electrical outlet, portions of the device being broken away for clarity.
Figure 7:
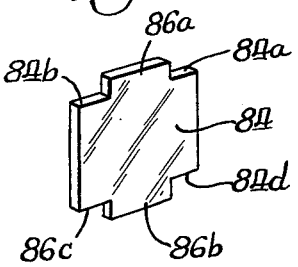
FIG. 7 is a perspective view of the reinforcing and tensioning member shown in FIG. 6.

FIGS. 5–10 illustrate another embodiment of a safety device, indicated generally at 50, in accordance with the present invention for retaining electrical plugs within electrical outlets so as to prevent partial or complete withdrawal by young children. The safety device 50 is adapted to be secured to an electrical wall outlet, designated generally at 12' in FIG. 5, so as to overlie an electrical receptacle comprising a pair of electrical outlet sockets 14'*a* and 14'*b* identical to the aforedescribed electrical sockets 14*a* and 14*b*. Each electrical socket has a pair of receptacle slots adapted to receive the electrical terminals or prongs 18' of an electrical plug 20' in a known manner. In the illustrated embodiment, the electrical sockets 14'*a* and 14'*b* are adapted to receive three-wire type plugs, having ground receptacle slots such as the "ground" receptacle slots 16*a* shown in FIG. 3. With such three-wire receptacles, conventional two-wire plugs are slightly off center when mounted within the electrical sockets 14'*a* and 14'*b* as shown in FIG. 5.

A feature of the safety device 50 is that it is adapted to be manipulated by an adult to facilitate insertion of a socket 20' or removal of the socket from an associated one of the electrical sockets 14*a*, *b* without having to completely remove the safety device 50 from the electrical wall outlet 12'.

Figure 6:
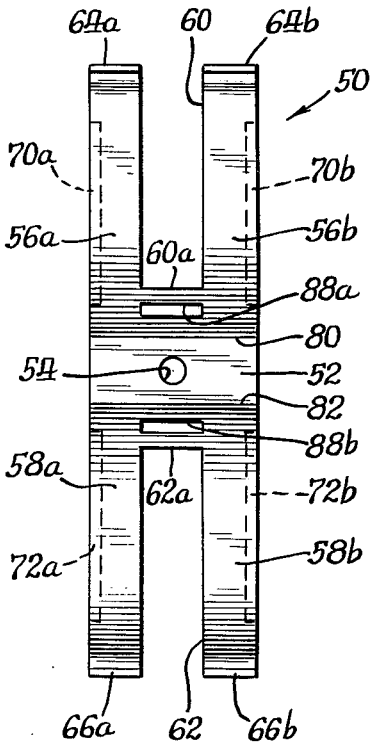
FIG. 6 is a front elevational view of the safety device of FIG. 1 but detached from the electrical outlet and with the spring tensioning member removed.

The safety device 50 includes a planar base portion 52 which has a central opening 54 therethrough to facilitate attachment of the base portion to the electrical receptacle 12' by a screw 26' in similar fashion to mounting of the aforedescribed safety device 10. A pair of identical bifurcated arm portions are formed integral with the base 52 and extend outwardly therefrom in opposite directions, each bifurcated arm portion being defined by a pair of parallel spaced arms 56*a*, 56*b* and 58*a*, 58*b*, respectively. The pairs of spaced arms 56*a*, *b* and 58*a*, *b* define longitudinally extending slots 60 and 62 therebetween, respectively, the inner ends of which terminate at end surfaces 60*a* and 62*a* as shown in FIG. 6.

Noting FIG. 5, the bifurcated arm portions 56*a*, *b* and 58*a*, *b* are formed so as to extend angularly away from the plane of the base portion 52 and are generally arcuate in side profile configuration, each pair of parallel arms having sufficient arcuate curvature to receive a corresponding one of the electrical plugs 20' thereunder. The pairs of arms 56*a*, *b* and 58*a*, *b* terminate at their outer ends in upwardly curved end tab portions 64*a*, *b* and 66*a*, *b*, respectively, the curved end portions normally engaging the outer surface of the cover plate 24 when the safety device 50 is assembled thereagainst. When used with a three-prong or grounded electrical receptacle wherein the electrical plugs 20' are offset from center as shown in FIG. 5, the outer ends of one pair of the arms 56*a, b* and 58*a, b* may be spaced slightly outwardly from the cover plate 24'.

The planar portion 52 and integral bifurcated arm portions 56*a, b* and 58*a, b* are preferably made from a suitable plastic material. To prevent manipulation of the bifurcated arm portions by a child in a manner which would allow partial or complete removal of an associated electrical plug 20', webs or side walls 70*a,* 70*b* and 72*a,* 72*b* are formed integral with the bifurcated arm portions 56*a,* 56*b,* 58*a,* and 58*b,* respectively, adjacent their outer edges so as to form reinforcing protective skirts integral with each pair of bifurcated arms. The integral side walls 70*a, b* and 72*a, b* maintain the associated arm portions 56*a, b* and 58*a, b* in their arcuate configurations and substantially increase the rigidity thereof. Additionally, the side walls 70*a, b* and 72*a, b* prevent insertion of a child's fingers behind the bifurcated arm portions and thereby prevent access to the associated electrical plugs 20' by a young child.

To provide additional reinforcement and tension in the oppositely directed bifurcated arm portions 56*a, b* and 58*a, b* and prevent the bifurcated arm portions from being bent or pulled by a child outwardly relative to the plane of the base portion 52 about transverse lines of connection 80 and 82 (FIG. 6), a spring tensioning and reinforcing member 84 is interconnected to and between the bifurcated arm portions as shown in FIG. 5. The tensioning member 84 preferably has a lateral width equal to or slightly less than the lateral width of the base portion 52. The spring tensioning member 84 has oppositely directed end tabs 86*a* and 86*b* of sufficient size to be received within transverse slots 88*a* and 88*b* formed in the bifurcated arm portions adjacent and parallel to the slot end surfaces 60*a* and 62*a,* respectively, as shown in FIG. 6.

The end tabs 86*a* and 86*b* are of shorter lateral width than the remaining portion of the spring tensioning member 84 so as to define stop surfaces 84*a,* 84*b,* 84*c* and 84*d.* With the safety device 50 mounted on the cover plate 24' through the screw 26', the end tabs 86*a,* 86*b* are inserted into the slots 88*a* and 88*b,* respectively, and the stop surfaces 84*a–d* engage the bifurcated arm portions adjacent the slots 88*a, b.* The spring tensioning member 84 is preferably made of spring steel or other suitable material and has sufficient longitudinal length so that when assembled within the slots 88*a,* 88*b,* neither bifurcated arm portion may be pulled or bent outwardly by a child from the cover plate 24' about the transverse lines 80 and 82. This increased rigidity and reinforcement prevents a child from bending either of the bifurcated arm portions away from the receptacle cover and thereby prevents partial or complete withdrawal of either of the associated electrical plugs 20'. On the other hand, the spring tensioning member 84 has sufficient flexibility that an adult can pull either bifurcated end portion of the safety device 50 outwardly from the receptacle cover 24' a distance sufficient to allow insertion or withdrawal of an electrical plug 20' while the safety device 50 is secured to the cover plate by the screw 26'.

The end tabs 86*a,* 86*b* on the tensioning member 84 preferably extend longitudinally outwardly sufficiently to retain the tensioning member in assembled relation with the bifurcated arm portions of the safety device 50 and prevent removal of the tensioning member by a child, but allow an adult to remove the tensioning member by insertion of a tool, such as a screwdriver, behind it and force the tabs 86*a,* 86*b* from the slots 88*a, b.* Such removal of the tensioning member provides access to the screw 26' for complete removal of the safety device 50 when desired.

Figure 8:
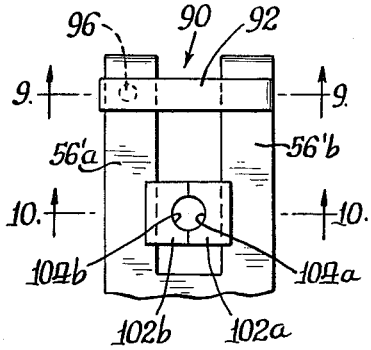
FIG. 8 is a partial front elevational view of the safety device of FIG. 6 but showing the adjacent ends of one of the bifurcated arm portions connected to increase rigidity, and with a cord protector disposed between the parallel arms.
Figure 9:
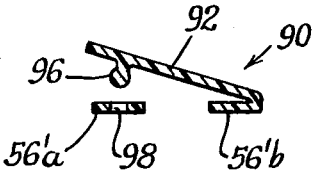
FIG. 9 is a transverse sectional view taken substantially along the line 9—9 of FIG. 8, looking in the direction of the arrows.

FIG. 8 illustrates an additional feature of the safety device in accordance with the present invention wherein means, indicated generally at 90, are provided to interconnect the corresponding pairs of bifurcated arms so as to prevent an individual one of the arm portions, such as indicated at 56'*a* or 56'*b,* from being manipulated independently of the other. To this end, the stabilizing means 90 includes a stabilizer arm 92 which, in the illustrated embodiment, is formed of a plastic material integral with and hingedly connected to the outer lateral edge of the arm portion 56'*b* so as to be pivotally movable relative thereto. The arm 92 carries a detent keeper 96 in the form of a ball or other suitable configuration integral with the arm 92 and disposed to be received within a suitable slot 98, such as a circular opening, in the underlying leg portion 56'*a.* In this manner, the arm 92 may be releasably affixed to the leg portion 56'*a* and thus maintains the arms 56'*a* and 56'*b* in connected stabilized relation.

Figure 10:
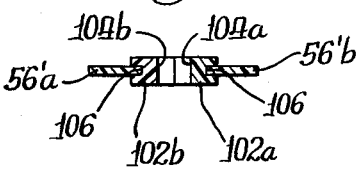
FIG. 10 is a transverse sectional view taken substantially along the line 10—10 of FIG. 8, looking in the direction of the arrows.

It may at times be desirable to provide additional clamping and locating means for the electrical cords 22' extending from the electrical plugs 20' when they are disposed between the bifurcated arms 56*a, b* and 58*a, b.* In such case, means in the form of a cord centering device, indicated generally at 100, may be releasably attached to and between each pair of bifurcated arms to receive the associated cord 22' therethrough. With particular reference to FIGS. 8 and 10, the cord centering means 100 includes a pair of identically shaped centering elements 102*a* and 102*b* each of which has a semicircular recess 104*a,* 104*b,* respectively, formed therein. Each of the centering elements 102*a, b* includes a longitudinally extending groove 106 in its lateral edge which is adapted to receive a corresponding one of the bifurcated arm portions 56'*a,* 56'*b* such that the cord centering elements may be moved along the lengths of the associated arm portions and positioned to form a circular opening therethrough to receive the associated cord 22'. The cord centering means 100 prevents sliding engagement of the cord against either of the bifurcated arm portions in a manner as might cause undesirable wear of the electrical cord insulation material.

Thus, in accordance with the present invention, a safety device is provided which is simple in construction and which may be economically manufactured. The embodiments of the safety device of the present invention may be readily installed on a conventional electrical wall outlet 12 and, when in engagement with electrical plugs 20 received within the electrical outlet sockets, retain the plugs in a manner to prevent a young child from partially or completely withdrawing the plugs from the electrical outlet sockets.

While preferred embodiments of the present invention has been illustrated and described, it will be understood to those skilled in the art that changes and modifications may be made therein without departing from the invention in its broader aspects. Various features of the invention are defined in the following claims.

What is claimed is:

1. A safety device for use in retaining an electrical plug or the like within an electrical outlet socket, said device comprising a unitary member having a base portion adapted to be secured to an electrical outlet, and a pair of bifurcated arm portions extending away from said base portion in opposite directions therefrom, said bifurcated arm portions each having a generally arcuate side profile and defining a pair of spaced arms adapted to extend over and engage the outwardly extending portion of an electrical plug when plugged into the electrical outlet socket to which the device is secured with the cord of the plug extending between said spaced arms, said spaced arms being of sufficient rigidity to prevent unintentional withdrawal of the plug from the socket.

2. A safety device as defined in claim 1 wherein said electrical outlet socket includes a pair of outlet sockets and has a threaded opening therebetween, and wherein said base portion of said device is adapted to engage said outlet socket adjacent said threaded opening, said base portion having means associated therewith facilitating attachment of said base to said outlet by means of said threaded opening.

3. A safety device as defined in claim 1 which is made electrically nonconductive.

4. A safety device as defined in claim 1 including cord centering means supported by at least one pair of said bifurcated arm portions and adapted to receive an electrical cord therethrough spaced between said bifurcated arms.

5. A safety device as defined in claim 1 including stabilizing means releasably interconnecting adjacent ends of selected ones of said spaced arms.

6. A safety device as defined in claim 1 wherein said base portion is generally planar, and wherein said bifurcated arms extend outwardly from the plane of said base portion and define spaced arms having arcuate side profiles such that said arms are concave relative to an associated plug when said device is secured to an electrical outlet with said arms in engagement with a plug the electrical cord of which extends between said arms.

7. A safety device as defined in claim 6 wherein said bifurcated arms are made so as to prevent removal by a young child of a plug retained by said bifurcated arms, but which can be manipulated by an adult to allow removal of the associated plug without detaching said device from an associated electrical outlet socket when secured thereto.

8. A safety device as defined in claim 7 wherein said base portion is generally planar and has an opening therethrough facilitating attachment of said device to an electrical wall outlet by a screw, said bifurcated arms defining pairs of substantially parallel spaced arms having arcuate side profile such that concave portions of said pairs of arms engage associated plugs to retain said plugs within associated electrical sockets, said pairs of arms having tabs formed on free ends thereof.

9. A safety device for use in retaining an electrical plug or the like within an electrical outlet socket, said device comprising a unitary member having a base portion adapted to be secured to an electrical outlet, and a pair of bifurcated arm portions extending away from said base portion in opposite directions therefrom, said bifurcated arm portions each having a generally arcuate side profile and defining a pair of spaced arms adapted to extend over and engage the outwardly extending portion of an electrical plug when plugged into the electrical outlet socket to which the device is secured with the cord of the plug extending between said spaced arms, said bifurcated arms being made so as to prevent removal by a young child of a plug retained by said bifurcated arms, but which can be manipulated by an adult to allow removal of the associated plug without detaching said plug from an associated electrical outlet socket when secured thereto, each of said spaced arms having a skirt wall secured to a lateral edge thereof so as to prevent finger access to an associated plug.

10. A safety device as defined in claim 9 including a tensioning member separate from but attachable to said bifurcated arm portions so as to prevent movement of said bifurcated arm portions relative to said base portion by a child.

11. A safety device as defined in claim 10 wherein said tensioning member has a pair of end tabs formed thereon, and wherein each of said bifurcated arm portions includes a slot therein adapted to receive one of said end tabs on said tensioning member so as to releasably retain said tensioning member in assembled relation with said bifurcated arm portions.

* * * * *